US005957701A

United States Patent [19]

McMillin

[11] Patent Number: 5,957,701

[45] Date of Patent: Sep. 28, 1999

[54] ELECTRICAL OUTLET EXTENSION

[76] Inventor: Kenneth G. McMillin, Rt. 10 Box 91L, Santa Fe, N.Mex. 87501

[21] Appl. No.: 08/871,841

[22] Filed: Jun. 6, 1997

[51] Int. Cl.[6] ..... H01R 39/00

[52] U.S. Cl. ..... 439/13; 439/32; 439/652

[58] Field of Search ..... 439/32, 373, 13, 439/651, 652

[56] References Cited

U.S. PATENT DOCUMENTS

| | | | |
|---|---|---|---|
| 2,269,779 | 1/1942 | Morten . | |
| 2,408,442 | 10/1946 | O'Brien . | |
| 2,611,800 | 9/1952 | Naughton . | |
| 4,037,900 | 7/1977 | Scmidger . | |
| 4,245,873 | 1/1981 | Markowitz | 439/32 |
| 4,553,798 | 11/1985 | Murphy | 439/32 |
| 5,554,039 | 9/1996 | Doudon | 439/13 |

*Primary Examiner*—Gary F. Paumen
*Attorney, Agent, or Firm*—Kenneth L. Tolar

[57] ABSTRACT

A device that can easily extend an existing wall socket that is obstructed by furniture or other items to allow access thereto includes an electrical outlet box having a sleeve extending from a side thereof and one or more female electrical receptacles on its exterior surface. A substantially flat base member having two planar sides is slidably extendible within the sleeve of the outlet box. The base component has an aperture for receiving a rotatable male plug component which allows the device to be rotated relative to the male plug component and extended horizontally or vertically as desired. Each male plug component is electrically connected to each of the female receptacles. The male plug component is plugged into a standard wall outlet, the outlet component is rotated and extended to a desired position and attached to a wall using an attachment means.

4 Claims, 3 Drawing Sheets

ELECTRICAL OUTLET EXTENSION

BACKGROUND OF THE INVENTION

The present invention relates to an electrical outlet extension which allows easier access to obstructed wall sockets. The device comprises an electrical outlet box with a sleeve extending therefrom. The outlet box has one or more female electrical receptacles for receiving a male plug from an electrical cord. A flat, substantially rectangular base component is slidably received within the sleeve of the outlet box allowing the box to be selectively extended away from the base component. The base component has a large aperture for receiving a rotatable male plug component which may be plugged into a standard wall receptacle. The rotatable plug component allows the outlet box to be selectively extended horizontally or vertically whenever the male plug component is plugged into a wall socket.

Power rings electrically interconnect the male plug component and the female receptacle using a telescoping electrical brush. This arrangement allows the female receptacle and male plug component to remain in electrical communication as the outlet box is extended or retracted. The rotatable plug component is plugged into a standard wall socket; tue electrical outlet box is extended vetically or horizontally to the desired position allowing an obstructed wall socket to be accessed. Alternatively, a transformer may be received within the outlet box or base component allowing it to also operate as a voltage converter.

DESCRIPTION OF THE PRIOR ART

Electrical cornnectors, junction boxes and other devices designed to extend the source of electrical power within buildings are generally known in the prior art. However, none of these devices address the problem associated with conveniently accessing electrical outlets that may be blocked by furniture or other items. U.S. Pat. No. 4,037,900 issued to Schmidger relates to a baseboard for electrical installations having a cover part which is fastened to a wall. The cover part has a plurality of extending bare wires which may be readily connected to adapters to form electrical switch apparatus or distributing elements in the baseboard.

U.S. Pat. No. 2,611,800 issued to Naughton, discloses electrical conductors permanently imbedded in strips of plastic to form sectional, removably attachable pieces of molding that may be used as a convenient, easy to assemble wiring system.

U.S. Pat. No. 2,408,442 issued to O'Brien relates to a wiring system comprising a plurality of interconnecting elongated conductor units.

U.S. Pat. No. 2,269,779 issued to Morton, relates to a wiring circuit comprising interconnecting electrical conduits each having electrical wall type sockets on an exterior side thereof. As indicated above, numerous varieties of electrical connectors and wiring systems exist that make it easier and simpler to extend electrical power to other locations in a room, home, or building. However, none of these devices address the problem of accessing standard electrical wall outlets that are blocked by televisions, stereos, furniture or appliances.

SUMMARY OF THE INVENTION

Electrical wall sockets are typically placed one to two feet from the floor. Due to space limitations and the design of a particular room, many of these wall sockets are blocked by appliances, televisions, stereos or furniture making access thereto impossible or difficult. Typically very heavy furniture will have to be moved and replaced each time an electrical cord is plugged into a wall socket or removed therefrom.

Extension cords, power strips, surge protectors and the like do not adequately address the problem. These devices cannot be secured to a wall making them cumbersome to use and possibly dangerous since exposed electrical sockets may be lying on the floor. Furthermore, a user still must move the obstruction each time the extension or power cord is to be unplugged. Therefore, there is currently a need for a device that will allow easy and convenient access to a blocked wall socket without having to move or relocate the obstruction.

The present invention provides a permanent, more aesthetically appealing solution to the above described problem by providing an adapter that effectively extends a wall socket beyond an obstruction allowing easy access thereto. It is therefore an object of the present invention to provide a simple and easy to use electrical outlet extension.

It is yet another object of the present invention to provide an electrical outlet extension that may be selectively extended either vertically, horizontally or obliquely as desired It is yet another object of the present invention to provide an electrical outlet extension that remains in electrical communication with a wall socket regardless of the selected extension distance.

It is yet another object of the present invention to provide an electrical outlet extension that may be easily and quickly attached to a wall socket and/or a wall.

It is yet another object of the present invention to provide an electrical outlet extension that may also be interchangeably used as a 220/110 volt converter. Other objects, features and advantages of the present invention its details of construction and arrangements of parts will be seen from the following description of the preferred embodiment when considered with the attached drawings and the appended claims.

DESCRIPTION OF THE PREFERRED EMBODIMENT

Figure 2:
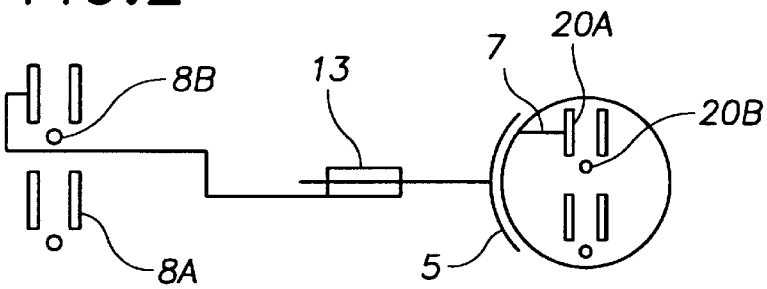
FIG. 2 shows a schematic of the cooperating electrical brush system interconnecting a rotating male plug component with a female plug receptacle on the electrical outlet box.
Figure 1:
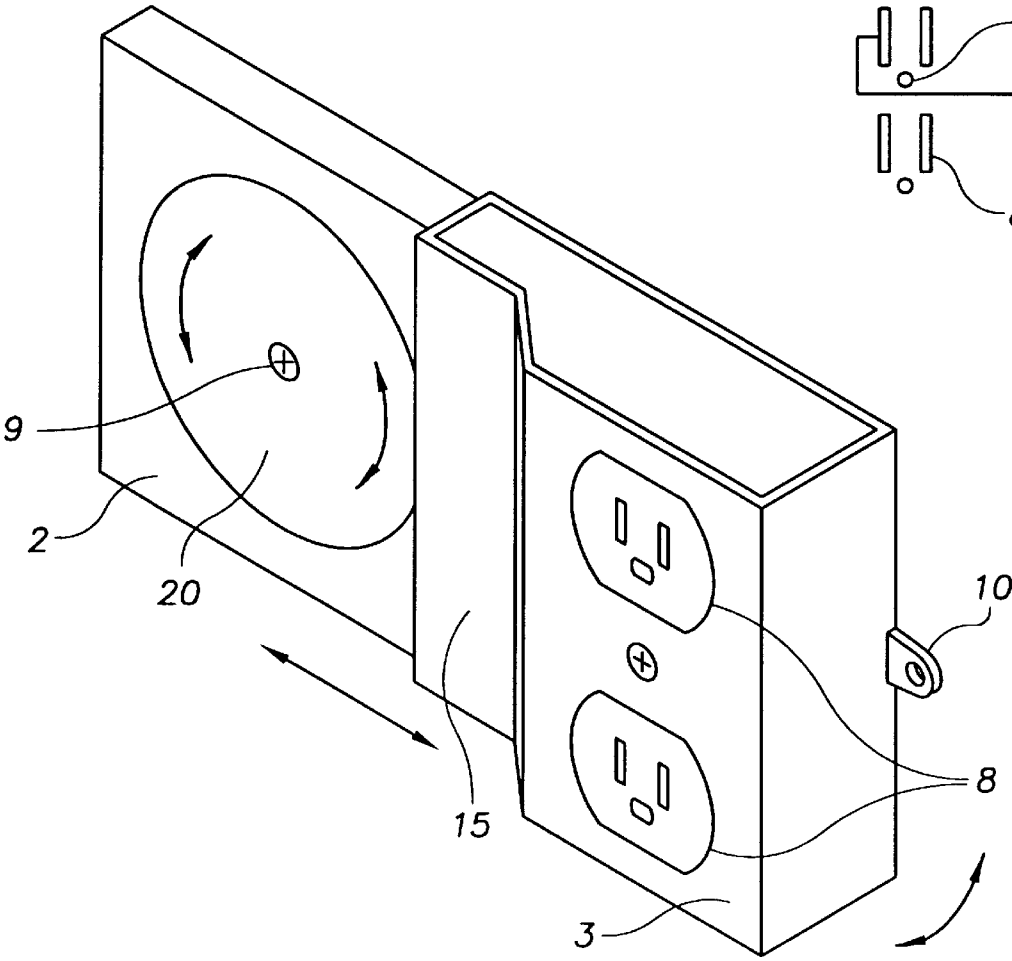
FIG. 1 shows the base member completely extended from the electrical outlet box
Figure 3:
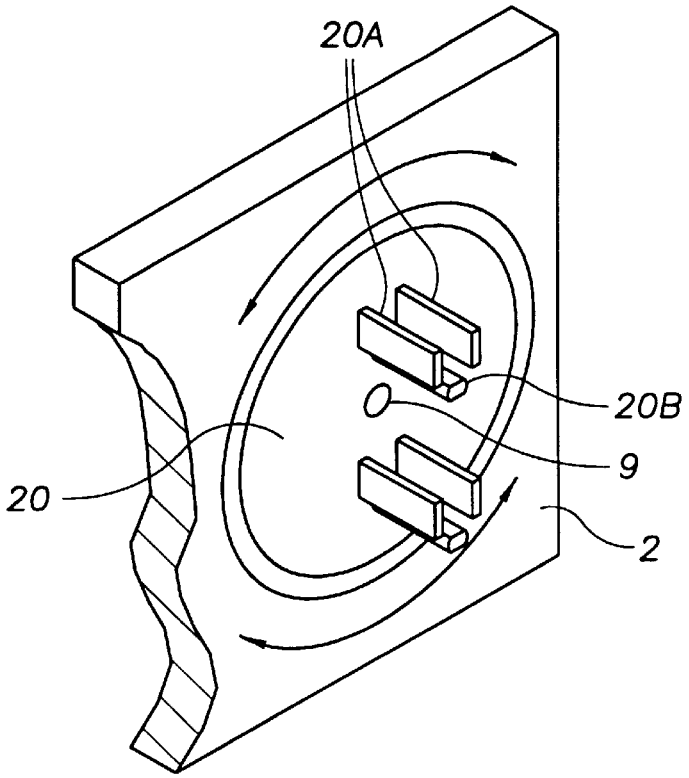
FIG. 3 illustrates the rotatable plug component.

Referring now to FIGS. 1 through 5, the invention generally relates to an electrical outlet extension allowing convenient access to obstructed electrical wall sockets. The device comprises a substantially hollow electrical outlet box 3 having an exterior surface and a substantially rectangular sleeve 15 extending from a side thereof. The sleeve 15 is in communication with the hollow interior portion of the outlet box 3. On the exterior surface of the outlet box 3 are one or more female electrical receptacles 8. The receptacles 8 are standard 110 Volt plug style receptacles known in the prior art and found on most wall sockets. Each has a pair of flat hot blade receptacles 8A and a ground plug receptacle 8B for receiving corresponding hot blades and ground plug from an electrical cord.

Received within the sleeve 15 and slidably engaging the interior thereof is a substantially rectangular base component 2 with an aperture therethrough. Preferably, there is a stop means on a distal end of said base component to prevent it from sliding completely out of said sleeve. Received within the aperture is a rotatable male electrical plug component 20. The rotatable male plug component 20 comprises a substantially circular wheel component having a planar side; extending from the opposing side of said wheel portion are a pair of hot blades 20A and preferably a ground plug 20B for inserting into a standard wall socket. The male plug component 20 is similar to a standard plug found on most electrical cords generally known in the prior art. The male plug component 20 may be secured within the aperture using a variety of attachment or securing means such as mating grooves, slots, tabs, etc.

The rotatable male plug component 20 allows the outlet box 3 and the extended base component 2 to rotate relative to the male plug component 20 whenever the device is plugged into a wall socket. Accordingly, the device may be selectively extended in a vertical, horizontal or even an oblique direction.

Figure 4:
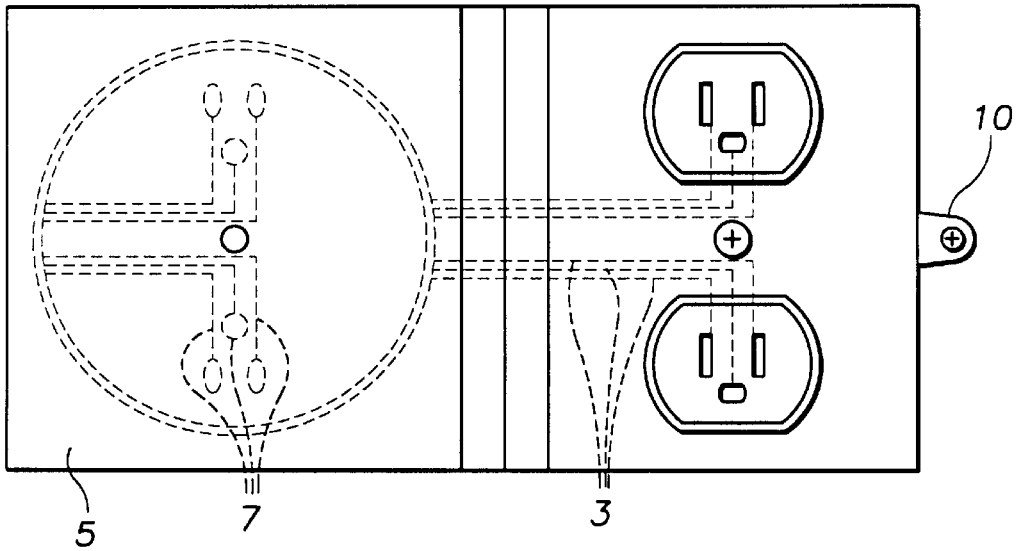
FIG. 4 is a cross sectional view of the base component depicting the interconnecting electrical power busses and power ring in phantom and the wall attachment means on a side of the outlet box.
Figure 5:
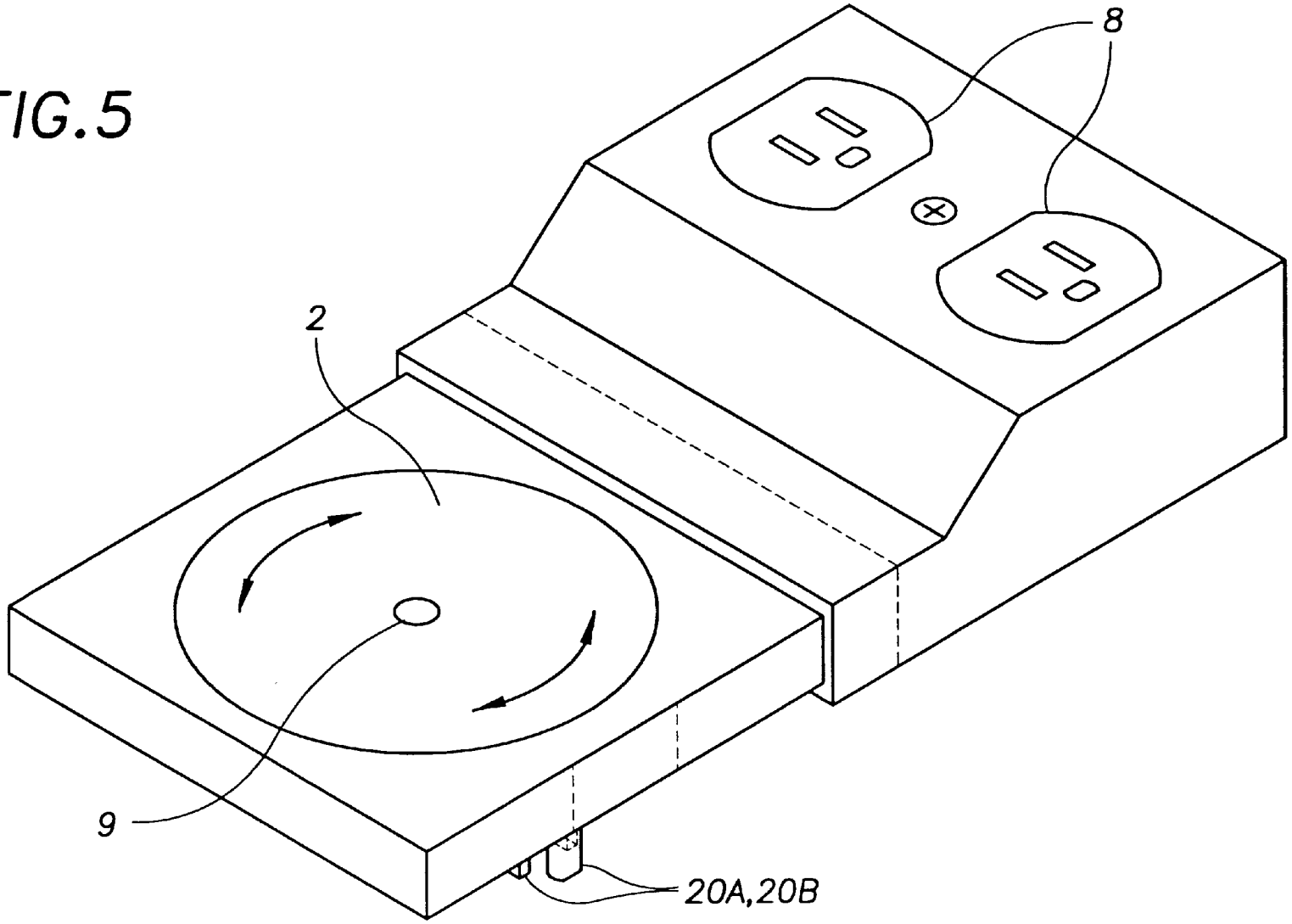
FIG. 5 is a bottom view of the device depicted in FIG. 1 with the male plug component extending from a side of the base component.

Within said base component 2 is a circular power ring 5 proximal said male plug component 20. The power ring 5 is made from a highly conductive material. A series of power busses 7 electrically connect the male plug component 20 to the power ring 5. Preferably, three separate power busses are used, two to connect each hot blade 20A, and a third to connect the ground plug 20B to the ring 5 as shown in FIG. 4.

The power ring 5 is electrically connected to a telescoping electrical brush 13. A second set of power busses 3 are connected to each hot blade receptacle 8A and ground plug receptacle 8B on the female receptacle 8 and to said telescoping brush 13. Electrically interconnecting the male plug component 20 and the female receptacle 8 in this manner allows the two components to remain in electrical communication with each other as the outlet box 3 is extended or retracted In addition, as depicted in FIGS. 2 and 4, the power ring 5 allows electrical communication between the male plug component 20 and the female receptacle 8 to remain intact as the plug component or the extended outlet box 3 is rotated.

The rotatable male plug component 20 has a centrally located aperture through which is an attachment means 9 such as a bolt or screw allowing the base component 2 to be easily attached to a conventional wall socket. Preferably, the base component 2 would replace the conventional wall outlet face plate. Extending from a side of the outlet box is a ring or hook with a screw or bolt received therethrough, or another similar attachment means 10, allowing the outlet box 3 to be removably attached to a wall. In another embodiment, the electrical outlet box 3 would also have a transformer received therein giving the device the additional capability of functioning as a voltage converter.

To use the above described invention the user would first remove the existing wall outlet face plate and plug in the male plug component 20 into an existing wall socket. Using the attachment means 9, the user would then attach the base component 2 to the existing outlet, preferably using the same screw access hole used for the wall socket face plate. The outlet box 3 is then selectively rotated and extended to a desired position. Using the attachment means 10, the outlet box 3 may then be attached to a wall at a desired location. Appliances, furniture or other obstructions could then be relocated in front of the existing wall socket allowing a user to plug electrical cords into the unobstructed outlet extension. In addition, the device described above may be installed and used as a voltage converter.

As will be appreciated by those skilled in the art to which the present invention applies, the electrical outlet extension may be constructed in various dimensions, sizes, shapes using various materials. The outlet box 3 and base component 2 could be manufactured using plastic or any other similar non-conductive material. The conductive components are preferably manufactured from stamped spring steel that is heavily electroplated with brass. However, many other similar conductive materials can be used. For illustration purposes only, the electrical outlet extension pictured in FIGS. 1–5 has a pair of male plug components in electrical communication with two female receptacles. However, as will be readily apparent to those skilled in the art to which the invention applies, various numbers of male plug components may be attached to a side of the base component which may then be electrically connected to a variable number of female receptacles depending upon the application.

Therefore, the foregoing is considered illustrative only of the principles of the invention. It is understood that all though there has been shown and described the preferred embodiment of the described invention, that modifications may be made to the invention and equivalents may be resorted to which fall within the scope of the invention and do not exceed the scope of the appended claims. Accordingly the scope of my invention is to be limited only by the following claims.

I claim:

1. An electrical outlet extension for use with an electrical wall socket comprising:

a substantially hollow electrical outlet box having an exterior surface and a sleeve extending therefrom;

a female electrical receptacle on the exterior surface of said electrical box;

a base component slidably received within said sleeve and extendable therefrom;

a rotatable male electrical plug component attached to said base component;

means for maintaining electrical communication between said male component and said female receptacle as said outlet box is rotated relative to said male plug whereby said male component may be coupled with said electrical wall socket and said outlet box is extended in a desired direction to circumvent an obstruction to said wall socket.

2. A device according to claim 1 wherein said means for means for maintaining electrical communication comprises:

a telescoping electrical brush component received within said outlet box and electrically connected to said female receptacle;

a power ring electrically connected to said telescoping brush and to said male plug component.

3. A device according to claim 1 further comprising means for securing said base component to said wall socket.

4. A device according to claim 1 further comprising means for securing said outlet box to a wall.

5,957,701
5 6

* * * * *